United States Patent [19]

Williamson

[11] 4,227,946

[45] Oct. 14, 1980

[54] NO-RINSE PRE-PAINT COATING COMPOSITION AND METHOD

[75] Inventor: Stanley C. Williamson, Sea Bright, N.J.

[73] Assignee: Oakite Products, Inc., Berkeley Heights, N.J.

[21] Appl. No.: 10,975

[22] Filed: Feb. 9, 1979

[51] Int. Cl.[2] ..... C23F 7/08; C23F 7/26

[52] U.S. Cl. ..... 148/6.16; 148/6.2

[58] Field of Search ..... 148/6.16, 6.2

[56] References Cited

U.S. PATENT DOCUMENTS 2,768,104 10/1956 Schuster et al. ..... 148/6.16

3,720,549 3/1973 Hirst ..... 148/6.16

*Primary Examiner*—Ralph S. Kendall

*Attorney, Agent, or Firm*—A. A. Orlinger

[57] ABSTRACT

An acid aqueous coating composition and concentrate of chromic acid and chromium phosphate derived from phosphoric acid resulting from the oxidation of hypophosphorous acid in reacting with the chromic acid. The chromic acid is present in a stoichiometrically equivalent amount from about one percent to about one hundred percent over that needed to oxidize hypophosphorous acid to phosphoric acid. The composition may also contain a non-foaming wetting agent and particulate silica.

15 Claims, No Drawings

NO-RINSE PRE-PAINT COATING COMPOSITION AND METHOD

This invention is that of aqueous compositions effective for providing the surfaces of metals, such as iron, steel, galvanized iron or steel, zinc, aluminum, copper and brass, a so-called no-rinse, paint pre-coat that enables any number of paints, such as alkyd, polyester, vinyl, epoxy, polyurethane, silicone ester, and alkyd melamine paints and others, with excellent bonding to the selected metal substrate.

The pre-paint coating is referred to as no-rinse because after the metal surface is treated with an aqueous composition of the invention, the treated metal surface does not need to be rinsed for it is finished and ready to receive the selected paint coating after mere air drying or forced air oven drying (the latter at about 65.6° C. for about 3 to 5 minutes).

These aqueous compositions of the invention provide enhanced adhesion and excellent bonding of the various paints to the metals, by containing dissolved in their water primarily chromic acid (i.e. from chromium trioxide dissolved in the water) and chromium phosphate ($CrPO_4$) resulting from the chromic acid and phosphoric acid as derived from reacting chromic acid and hypophosphorous acid, with the chromic acid present to the extent of from at least about one percent to about one hundred percent over the stoichiometrically needed to oxidize the hypophosphorous acid to phosphoric acid.

The wetting of the metal surfaces of these new aqueous compositions can be enhanced by including in a specific embodiment a non-foaming or low foaming wetting agent inert to the metal to be treated, to the high acidity of the composition and also to oxidation. A low foaming wetting agent is one whose bubbles break down readily even without stirring.

Then also, for example, for treating an aluminum surface, particularly when a polyester paint is to be applied to it and the painted metal is to be subjected to severe forming, the bonding of the paint to the metal surface was found to be enhanced by pretreating it with a different embodiment of these compositions including in it colloidally dispersed silica (as described further below).

The invention includes (a) concentrates of these aqueous compositions such as would be prepared by suppliers of them, and (b) treating baths prepared by the metal treaters by using a suitable dilution of any of the concentrates, as well as (c) the method of treating the metal surfaces with the selected treating bath to enhance the adhesion or bonding of the thereafter to be applied paint coat.

Earlier available chromium-containing preparations for treating metal surfaces which were to be painted over exhibit various disadvantages. For example, after application of the treating preparation, a rinsing operation is needed, which presents the accompanying disposal problem from chromium cation in the effluent reaching neighboring streams. Others require subjecting the metal coated with the applied treating preparation to elevated temperatures such as at least about 71° C. to complete the metal surface treatment. The earlier available preparations also require bleeding out depleted bath content and feeding in fresh composition along with involved analytical methods for use to guide in controlling the treating bath activity. These disadvantages and others are avoided by use of the compositions and method of this invention.

Considered broadly, the aqueous compositions of the invention contain dissolved in their water:

chromic acid (from solution of chromium trioxide in water) and chromium phosphate as resulting from chromic acid and phosphoric acid as derived from reacting chromic acid and hypophosphorous acid with the chromic acid present in a stoichiometrically equivalent amount from about one percent to about one hundred percent over that needed to oxidize the hypophosphorous acid to phosphoric acid, from none to about 0.01% of a wetting agent as above described; and from none to about seven percent of finely divided silica of from about 4 to about 60 millimicrons particle size (i.e. colloidal) and optimally from 4 to about 25 millimicrons (the particles in the 4 millimicron range being actually dissolved); which compositions can be:

(i) a concentrate with its solids (dissolved and any colloidally dispersed) content, being from about two percent to an amount below that at which the composition will gel under the conditions at which it is stored; and (ii) a metal treating bath composition with its total solids content being from two percent to about fifteen percent, and optimally from about five to about ten percent, of that of the concentrate.

In the concentrate the excess of chromium trioxide should be at least an amount sufficient to enable the concentrate to remain stable (i.e. against gelling) at least for the interval of time from its preparation to that when it is to be diluted to provide a metal treating bath. It occurs that the extent of excess of chromic acid over the hypophosphorous acid in the compositions influences the time over which the product remains stable. For example, a concentrate having a minimum of about a 40% excess of chromic acid stoichiometrically over the hypophosphorous acid can be expected to remain stable indefinitely.

The storage life of the concentrate decreases as the excess chromic acid content decreases. For example, a concentrate including 0.0045% of the MONOFLOR 31 anionic wetting agent product of ICI UK Ltd., London) and having a 10% stoichiometrical excess over the hypophosphorous acid remained stable for about a month when stored at 50° C.

Such a concentrate, however, would remain stable for a longer period of time if stored at an ambient temperature of from 20° to 25° C. and can be used before it reaches its gelling stage if it is diluted to a concentration suitable for use as a treating bath. A concentrate with as little as 1% excess chromic acid would gel in 2 to 3 days if stored at 47° C. and in a somewhat longer period if stored at the lower ambient temperature, but could be used before it gels if diluted to the extent needed for use as a treating bath.

The treating baths of the invention, because of the excess chromic acid, are generally quite acidic, for example, those prepared from 5% to 10% by volume of concentrate show pH 2.0 to 2.2.

The concentrates of the invention are prepared better by mere diluting of the 50% aqueous hypophosphorous acid with the water and admixing the chromic acid into the diluted hypophosphorous acid beneficially at a rate to avoid boiling (from the exothermicity). When any wetting agent and/or silica is to be added, it is desirable to admix whichever of them is to be added into the water before the aqueous hypophosphorous acid.

The metal treating baths of the invention then are readily prepared by admixing the quantity of concentrate into the required amount of water to provide the selected or desired treating bath dilution.

The treating baths of the invention can be applied to the surfaces of the selected one of the various metals to be treated by the spraying, immersing or brushing methods used in the art and depending on the physical form of the metal surface to be treated, such as whether in the form of rolls of sheet metal, coils of wire, or different produced forms depending on the end use to be made of the product.

The concentrate aqueous compositions of the invention are illustrated by, but not restricted to, the following examples, wherein the composition contains chromic acid and chromium phosphate from chromic acid and phosphoric acid resulting from the oxidation of hypophoshorous acid, and the parts of the respective constituents are by weight:

EXAMPLE 1—Solution Of Both Acids

50% hypophosphorous acid: 7.11
chromium trioxide: 10.80
water: 82.09.

EXAMPLE 2—Both Acids And A Wetting Agent

50% hypophosphorous acid: 7.11
chromium trioxide: 10.80
anionic wetting agent (MONOFLOR 31): 0.0045
water: 82.0855.

EXAMPLE 3—Both Acids And Colloidal Silica

50% hypophosphorous acid: 7.2
chromic acid (as $CrO_3$): 10.80
colloidal silica aqueous dispersion (34% $SiO_2$): 10.0
water: 72.0.

EXAMPLE 4—Both Acids, Colloidal Silica And Wetting Agent

50% hypophosphorous acid: 7.2
chromic acid (as $CrO_3$): 10.80
colloidal silica aqueous dispersion (34% $SiO_2$) 10.0
anionic wetting agent (MONOFLOR 31): 0.0045
water: 71.9955.

EXAMPLE 5—Both Acids With A Wetting Agent hypophosphorous acid (dry basis): 3.555%
chromium trioxide: 10.8000%
anionic wetting agent (MONOFLOR 31): 0.0045%
water: 85.6405%.

EXAMPLE 6—Both Acids, Silica And Wetting Agent hypophosphorous acid (dry basis): 3.6%
chromium trioxide: 10.8%
silica (particles 4 to 60 millimicrons): 3.4%
anionic wetting agent (MONOFLOR 31): 0.0045%
water: 82.1955%.

The readily available 50% hypophosphorous acid is used as the hypophosphorous acid source in the illustrative examples. Any other commercially available suitable hypophosphorous acid grade or concentration can be used in preparing the concentrate. The chromium trioxide (i.e. chromium anhydride) can be used in any of its commercially readily available suitable forms. Of these, the technical grade of the granular powder form is beneficial and desirable.

The total solids content of the concentrate compositions (i.e. both acids and any included surfactant and/or silica) should be below that at which the composition will gel under its storage conditions. The solid contents then can be from 2% to about 30% (by weight), beneficially from about 15% to 25%, and optimally (as presently seen) about 20%.

Any good quality of municipal water supply of generally acceptable low enough hardness may be used in preparing the concentrate, as well as in preparing the desired metal treating bath from the concentrate. However, with the current readily available water demineralizers, it is generally better to use demineralized water at least in preparing the concentrates. It is also beneficial to use demineralized water in preparing the treating baths in those locations where the available community or industrial water has an undesirable level of hardness.

While the above noted MONOFLOR 31 (bound fluorine mononuclear aromatic type of) wetting agent is included in certain examples, any other anionic wetting agent containing bound fluorine may be used, such as the perfluoroalkyl sulfonic acid surfactants having 8 carbon atoms in the alkyl chain, as perfluoro normal -octyl sulfonic acid, or 2,5-dimethylcyclohexyl sulfonic acid, may be used as well as any other anionic, or any nonionic or cationic surfactant so long as it is non-foaming to low foaming, and inert to any of the metals to be treated, to the acid level of the concentrates or baths and oxidation.

Treating bath compositions of the invention, which yield optimum results, are prepared by diluting from about 5 to about 10 parts by volume of any of the concentrates with water to give 100 volumes of treating bath (e.g. 5 liters of concentrate admixed with 95 liters of water). However, useful treating baths, that provide slightly less than optimum results, are prepared by similarly admixing from as low as 2% and as high as about 15% by volume of concentrate with water to make a total of 100% by volume of treating bath.

The treating baths prepared by use of 2% by volume of the concentrate, when applied to some steels, at times tend to develop a flash rust coating on the metal surface. Also, the treating baths prepared from over 10% by volume of concentrate provide acceptable physical properties, such as slightly less flexibility and lower impact resistance, in the final painted surface, thus not quite as good as results obtained from a bath prepared by using from about 5% to about 10% of concentrate by volume.

The treating baths are illustrated by, but not limited to, the following examples, wherein the bath contains the chromic acid and chromium phosphate as derived from chromic acid and phosphoric acid resulting from the oxidation of hypophosphorous acid, and the percentages of the constituents dispersed in the water are by weight:

EXAMPLE 7—Treating Bath With Both Acids hypophosphorous acid (per se): 0.25%
chromium trioxide: 0.38%
balance water: 99.37%.

EXAMPLE 8—Bath With Both Acids And A Wetting Agent hypophosphorous acid (per se): 0.25%
chromium trioxide: 0.76% anionic wetting agent (MONOFLOR 31): 0.00032%
balance water: 98.99%.

EXAMPLE 9—Bath With Both Acids And Silica hypophosphorous acid (per se): 0.252%
chromium trioxide: 0.756%
silica particles (as in Example 6): 0.238%
balance water: 98.754%.

EXAMPLE 10—Bath With Both Acids, Silica And Wetting Agent hypophosphorous acid (per se): 0.252%
chromium trioxide: 0.756%
silica particles (as in Example 6): 0.238%
wetting agent (MONOFLOR 31): 0.00032%
water (balance): 98.7537%.

Any of the changes which the first and fourth paragraphs after Example 6 state can be made in any of the Examples 1 through 6 likewise can be made in any of treating baths Examples 7 through 10. Then, to avoid making the disclosure prolix, each such additional example that results from making any of the foregoing available changes in any of Examples 1 through 10 is considered as if written out in full herein with any of the respective foregoing described available changes as well as with any changes in quantity of any of the constituents in any of the foregoing examples and any of the stated available modifications of any them.

Embraced in the invention is the method involving applying over the surface of any of the earlier above-mentioned metals a metal-treating film of any of the metal treating baths of the invention and then drying the wet applied film as a ready paint-receiving pre-coat which thereafter serves to enhance the bond between the thus pre-coat covered metal surface and any applied paint of those also earlier-above identified types of paints.

This aspect of the invention is the method of enhancing the adhesion of a paint having a synthetic polymer as its film-forming constituent to the surface of any of the metals selected from iron, steel, galvanized iron or steel, zinc, aluminum, copper and brass, by the combination of steps including (i) applying over the surface of the metal to be painted a continuous metal-treating film of an aqueous, metal surface-treating bath containing from 2% to about 15% by volume of any of the concentrates of Examples 1 to 6 hereof, at ambient temperature or higher but not exceeding about 60° C. and not exceeding about 43.3° C. when the applied metal-treating film contains silica particles, and (ii) drying the thus applied film as a paint pre-coat by subjecting the film to air drying at ambient temperature or forced air drying at a compatible temperature sufficient to dry the film at the rate of passage through the drying zone.

Before the continuous metal-treating film is to be applied to the metal surface to be pre-coated, the surface should be clean or cleaned with a finishing water rinse. The continuous film of the metal-treating bath can be applied to the metal surface by any of the applicable methods known to the art for applying a continuous aqueous liquid film such as immersion in the bath, The method of applying the metal-treating-film to the various metal surfaces concerned is illustrated by, but not restricted to, the following examples:

EXAMPLE 11—Treating Film Onto Steel Boxes

A treating-film application bath was prepared by admixing 5.5 parts by volume of the concentrate of Example 4 with 94.5 parts by volume of water in a tank (previously used for some other metal treatment) 10 feet long by 4 feet wide by 3 feet deep. Steel parts carried on a conveyor (previously used and designed to travel at about 4.5 feet per minute because of hand racking) were immersed in and passed through the bath.

The thus treating-film coated parts then were passed through a drying oven at a rate to allow them to be subjected for about 4 minutes to a forced air draft maintained at 65° C. to dry the paint pre-coat. The thus paint pre-coated parts then were passed through a paint spray zone and spray-coated with a modified vinyl paint coating. flowing the bath composition over the metal surface, spraying over it a mist of the treating composition, or brushing the treating composition over the metal surface.

The time for contacting the metal surface with the metal-treating bath composition need be only sufficient to apply a break-free film or continuous coating. The contact time thus is practically instantaneous with those application methods other than immersion. With the latter it need only be from about a couple to about 5 seconds or so depending on the size of the immersion tank and travel rate in immersing the metal (sheet, wire, or shaped articles) into, through and out of the immersion bath.

The temperature of the metal-treating composition during application of the treating-film need only be ambient (from about 15.6° C.) although, as in the immersion method the temperature could be increased in the range up to about 60° C.

The method of applying the metal-treating-film to the various metal surfaces concerned is illustrated by, but not restricted to, the following examples:

EXAMPLE 12—Treating Film On Galvanized Sheet Steel

A treating-film application bath, prepared by admixing 6.5 parts by volume of the concentrate of Example 2 with 93.5 parts by volume of water, was sprayed under conditions to provide a break-free continuous film over galvanized sheet steel drawn from a roll of it and passed through the spraying zone at a rate of 250 feet per minute.

The thus treating-film coated galvanized sheet steel then was passed through a drying oven equipped to remove the water from the applied film. The thus paint pre-coated galvanized sheet steel then continued on to the paint spray zone.

Where the metal to which there is to be applied a paint pre-coat with a bath embraced by this invention, is to be painted with an alkyd or a polyester paint, it is beneficial to apply the pre-coat-providing film from one of the treating-baths which contains silica.

The surface of the metals to which the paint pre-coat is applied as in the invention, particularly the iron, steel, galvanized iron and steel, and also copper, manifest enhanced corrosion resistance.

The treating baths of the invention provide a further advantage by also avoiding introduction of phosphate and even fluoride contamination in plant effluents. That is so because no reaction occurs in the treating except with the possibility of occurring to the minutest extent with zinc.

While the invention has been explained by detailed description of certain specific embodiments of it, it is understood that various substitutions or modifications can be made in any of them within the scope of the appended claims which are intended to cover also equivalents of these embodiments.

What is claimed is:

1. An acid, aqueous composition containing by weight dissolved in its water:

chromic acid and chromium phosphate as derived from phosphoric acid resulting from the oxidation of hypophosphorous acid in reacting with the chromic acid which latter is present in a stoichiometrically equivalent amount from about one percent to about one hundred percent over that needed to oxidize hypophosphorous acid to phosphoric acid, from none to about 0.01% of a non-foaming to low foaming wetting agent inert to iron, steel, galvanized iron or steel, zinc, aluminum, copper and brass, to the acidity of the composition and to oxidation;

from none to about seven percent of particulate silica of from about 4 to about 60 millimicrons particle size, and which composition is selected from:

(i) a concentrate with its aforesaid dispersed total solids content being from about two percent to an amount below that at which the composition will gel under its storage conditions; and (ii) a metal treating bath having as its total dispersed solids content the amount thereof provided by from about two percent to about fifteen percent by volume of the aforesaid concentrate.

2. The concentrate composition as embraced in claim 1, wherein the maximum of its total solids content is about 30%.

3. A concentrate composition as claimed in claim 2, wherein the total solids content is about 20%.

4. A concentrate composition as claimed in claim 2, wherein the chromium phosphate content is that corresponding to what is obtained from about 7% to 7.3% of 50% aqueous hypophosphorous acid, and the chromic acid content is that corresponding to from about 10.5% to about 11% of chromium trioxide.

5. A concentrate composition as claimed in claim 4, wherein the total solids content includes (a) chromium phosphate in an amount corresponding to about 7.11% of hypophosphorous acid and (b) chromic acid in an amount corresponding to about 10.8% of chromium trioxide.

6. A concentrate composition as claimed in claim 5, wherein the solids content includes also about 0.0045% to about 0.01% of an anionic wetting agent.

7. A concentrate composition as claimed in claim 5, wherein the wetting agent is present in about 0.0045%.

8. A concentrate composition as claimed in claim 5, wherein the solids content includes also about 3.4% of particulate silica.

9. A concentrate composition as claimed in claim 8, wherein the solids content includes also about 0.0045% of an anionic wetting agent.

10. An aqueous treating bath for applying to the surface of any of the metals named in claim 1 a metal-treating-film which on drying serves as a paint pre-coat, which bath comprises from about 2% to about 15% of the concentrate of claim 1.

11. A treating bath as claimed in claim 10, which comprises from about 5% to 10% of the concentrate referred to in claim 10.

12. A treating bath as claimed in claim 10 or 11, which contains no silica.

13. A treating bath as claimed in claim 10 or 11, which contains silica.

14. A treating bath as claimed in claim 10, which contains no wetting agent.

15. A treating bath as claimed in claim 14, which contains no silica.

* * * * *